US011091300B2

(12) United States Patent
Yu

(10) Patent No.: US 11,091,300 B2
(45) Date of Patent: Aug. 17, 2021

(54) SECURING DEVICE FOR BOX

(71) Applicant: Charles Yu, New Taipei (TW)

(72) Inventor: Charles Yu, New Taipei (TW)

(73) Assignee: Relocks Co., Ltd., New Taipei (TW)

( * ) Notice: Subject to any disclaimer, the term of this patent is extended or adjusted under 35 U.S.C. 154(b) by 157 days.

(21) Appl. No.: 16/427,923

(22) Filed: May 31, 2019

(65) Prior Publication Data

US 2020/0377265 A1 Dec. 3, 2020

(51) Int. Cl.
*B65D 43/02* (2006.01)

(52) U.S. Cl.
CPC ..... *B65D 43/0212* (2013.01); *B65D 2543/00092* (2013.01); *B65D 2543/00194* (2013.01); *B65D 2543/00296* (2013.01); *B65D 2543/00351* (2013.01)

(58) Field of Classification Search
CPC ..... B65D 43/22; B65D 43/0212; B65D 43/0216; B65D 43/0214; B65D 45/00; B65D 2543/00092; B65D 2543/00194; B65D 2543/00296; B65D 2543/00351; B65D 2543/00101; B65D 2543/00083; B65D 2543/00324; B65D 2543/00472; B65D 2543/00657; B65D 43/0206; B65D 2543/00694; B65D 2251/1025; B65D 2251/105; E05B 15/008
See application file for complete search history.

(56) References Cited

U.S. PATENT DOCUMENTS 1,334,245 A * 3/1920 Humphrey ..... B65D 43/26 220/285
3,536,251 A * 10/1970 Edwards ..... B65D 85/324 206/521.1
3,767,110 A * 10/1973 Congleton ..... B65D 43/164 220/4.23
4,805,797 A * 2/1989 Natori ..... B65D 43/0212 220/315
4,986,438 A * 1/1991 Borst ..... B65D 43/0218 220/315
9,155,132 B2 * 10/2015 Cheung ..... H05B 6/6408
9,917,429 B2 * 3/2018 Kaufman ..... H02G 3/14
(Continued)

FOREIGN PATENT DOCUMENTS

FR 2691952 A1 * 12/1993 ..... B65D 43/0256
FR 2791036 A1 * 9/2000 ..... B65D 51/1694
(Continued)

*Primary Examiner* — J. Gregory Pickett
*Assistant Examiner* — Abigail Elizabeth Guidry
(74) *Attorney, Agent, or Firm* — Thomas J. Nikolai; DeWitt LLP

(57) ABSTRACT

A box includes a base and a cover which is removably mounted to the base. The base includes a first room defined therein, and a connection strip extends from the periphery of the top opening of the base. A knob is formed on the connection strip. The cover includes a skirt extending from the periphery thereof so as to form a second room between the skirt and the cover. The skirt includes a U-shaped recess formed in the outside thereof such that the knob can be engaged with the U-shaped recess. The U-shaped recess includes a U-shaped inside wall formed between two outwardly projecting reinforcement ribs on the outside of the skirt to easily accommodate the knob therebetween.

7 Claims, 10 Drawing Sheets

(56) References Cited

U.S. PATENT DOCUMENTS

| | | | | |
|---|---|---|---|---|
| D883,752 | S * | 5/2020 | Carey | D7/605 |
| 10,689,157 | B2 * | 6/2020 | Morine | A47G 23/02 |
| 2003/0111476 | A1 * | 6/2003 | Serio, Jr. | A45C 13/008 220/835 |
| 2003/0121917 | A1 * | 7/2003 | Fore | B65D 1/44 220/4.22 |
| 2005/0127075 | A1 * | 6/2005 | Smith | B65D 43/0212 220/253 |
| 2009/0206082 | A1 * | 8/2009 | Vovan | B65D 43/0249 220/266 |
| 2010/0276422 | A1 * | 11/2010 | Vovan | B65D 43/021 220/260 |
| 2015/0225139 | A1 * | 8/2015 | Baker | B65D 25/108 206/45.24 |
| 2017/0283139 | A1 * | 10/2017 | Fosse | B65D 55/06 |
| 2018/0079568 | A1 * | 3/2018 | Shmeltzer | B65D 43/0239 |
| 2018/0141731 | A1 * | 5/2018 | Hsieh | B65D 55/024 |
| 2018/0334287 | A1 * | 11/2018 | Schaefer | B65D 1/22 |
| 2019/0144164 | A1 * | 5/2019 | Breyburg | B65D 43/22 220/495.01 |
| 2021/0053728 | A1 * | 2/2021 | Wang | B65D 51/242 |

FOREIGN PATENT DOCUMENTS

| | | | | |
|---|---|---|---|---|
| WO | WO-2018005859 | A2 * | 1/2018 | B65D 45/16 |
| WO | WO-2018042410 | A1 * | 3/2018 | B65D 43/0264 |
| WO | WO-2019040248 | A1 * | 2/2019 | B65D 43/24 |

* cited by examiner

SECURING DEVICE FOR BOX

BACKGROUND OF THE INVENTION

1. Fields of the Invention

The present invention relates to a securing device, and more particularly, to a securing device formed to one side of the cover of a box so as to be secured to the base of the box.

2. Descriptions of Related Art

The conventional plastic boxes are made by way of plastic injection molding. The plastic particles are put into a hot basket via a funnel and the plastic particles are melted and injected into a molding set. After the melted plastic particles are cooled and solidified, the product is formed at the inside of the molding set. However, this method requires more plastic material and is not friendly to the environment.

Another conventional way of forming plastic boxes is by vacuum molding, which includes a molding set and a softened plastic sheet which is sucked to the surface of the molding set by a vacuum pump so that the softened plastic sheet is formed as a semi-product with a desired shape. The semi-product is then pressed or cut into pieces. However, the thickness of the vertical wall of the product is thinner and is likely deformed due to removal from the mold. Therefore, the cover cannot properly fit onto the base. The products made by this method usually is designed to form a single as one-time use product which causes a lot of plastic waste.

Generally, the convention plastic cover includes a first lip with a hooking portion formed along periphery of the cover designed to engage a second lip formed on the base. The first lip may engage the second lip too loosely to be secured. Alternatively, the first lip on the cover may be engaged with the second lip on the base too tightly to be easily separated from each other. In the first case, the first lip barely touches the second lip, and the first lip or the second lip is easily deformed by squeezing, so that the cover cannot be secured to the base of the box. In addition, the first lip may be deformed because the content in the box are too heavy so that the first lip cannot be engaged with the second lip properly. In the second case, the hooking portion of the first lip may be too deep, or the second lip protrudes too far so that when mounting the cover to the base of the box, the hooking portion of the first lip is difficult to be engaged with the second lip. Alternatively, the hooking portion of the first lip may be difficult to be separated from the second lip. Also, the cover and/or the base of the box may be deformed if the cover is forcibly mounted to the base.

Yet another conventional securing device of a box lid is the engagement between a knob and a recess. Usually, the knob and the recess have the identical shape, and are engaged with each other by way of surface-to-surface. This type of engagement between the knob and the recess generates a higher resistance, and the cover is not easily engaged with or separated from the base due to tolerance of sizes. Therefore, the users have to use a larger force to complete the action between the knob and the recess, and this may case deformation to the cover and the base.

The present invention intends to provide a securing device for a box to ensure that the cover of a box can be secured to the base of the box without the shortcomings mentioned above.

SUMMARY OF THE INVENTION

The present invention relates to a box and comprises a base and a cover. The base has a first room defined therein, and a connection strip extends from the periphery of the top opening of the base. A knob is formed on the connection strip. The cover is removably mounted to the base, and includes a skirt extending from the periphery of the cover so as to form a second room between the skirt and the cover. The skirt includes a U-shaped recess formed in the outside thereof. The knob is engaged with the U-shaped recess.

Preferably, the base includes a first lip extending outward from the periphery of the top opening of the base. A second lip extends outward from the lower edge of the skirt.

Preferably, the connection strip includes an extension portion and the knob is formed on the extension portion.

Preferably, the knob includes a press portion defined in the top thereof. The press portion is a recessed area.

Preferably, a bending portion is formed at the connection portion between the connection strip and the first lip.

Preferably, the U-shaped recess includes two reinforcement ribs which extend perpendicularly from the outside of skirt of the cover. A U-shaped inside wall is formed between the two reinforcement ribs.

Preferably, the knob is a hollow cylindrical knob, an oval knob, a regular shape knob or an irregular shape knob.

Preferably, the base and the cover are round or polygonal shaped.

The primary object of the present invention is to provide a securing device formed on one end of the box to increase structural strength of the base and the cover, and the base and the cover are not deformed by squeezing. The engagement between the base and the cover is ensured, the cover is easily mounted to the base or is easily removed from the base without causing deformation to the base and cover.

Another object of the present invention is to improve the shortcomings of the method of vacuum molding, wherein the portion of the softened plastic sheet that is initially sucked to the surface of the molding set by a vacuum pump is easily attached with surplus material on the molding set such that the thickness of this portion will be thicker than expected. Alternatively, because the corner portions or the turning portions of the molding set are usually thicker than other areas of the molding set so that the plastic material of the products will become thinner at the corner portions or the turning portions. The present invention can improve the shortcomings mentioned above.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
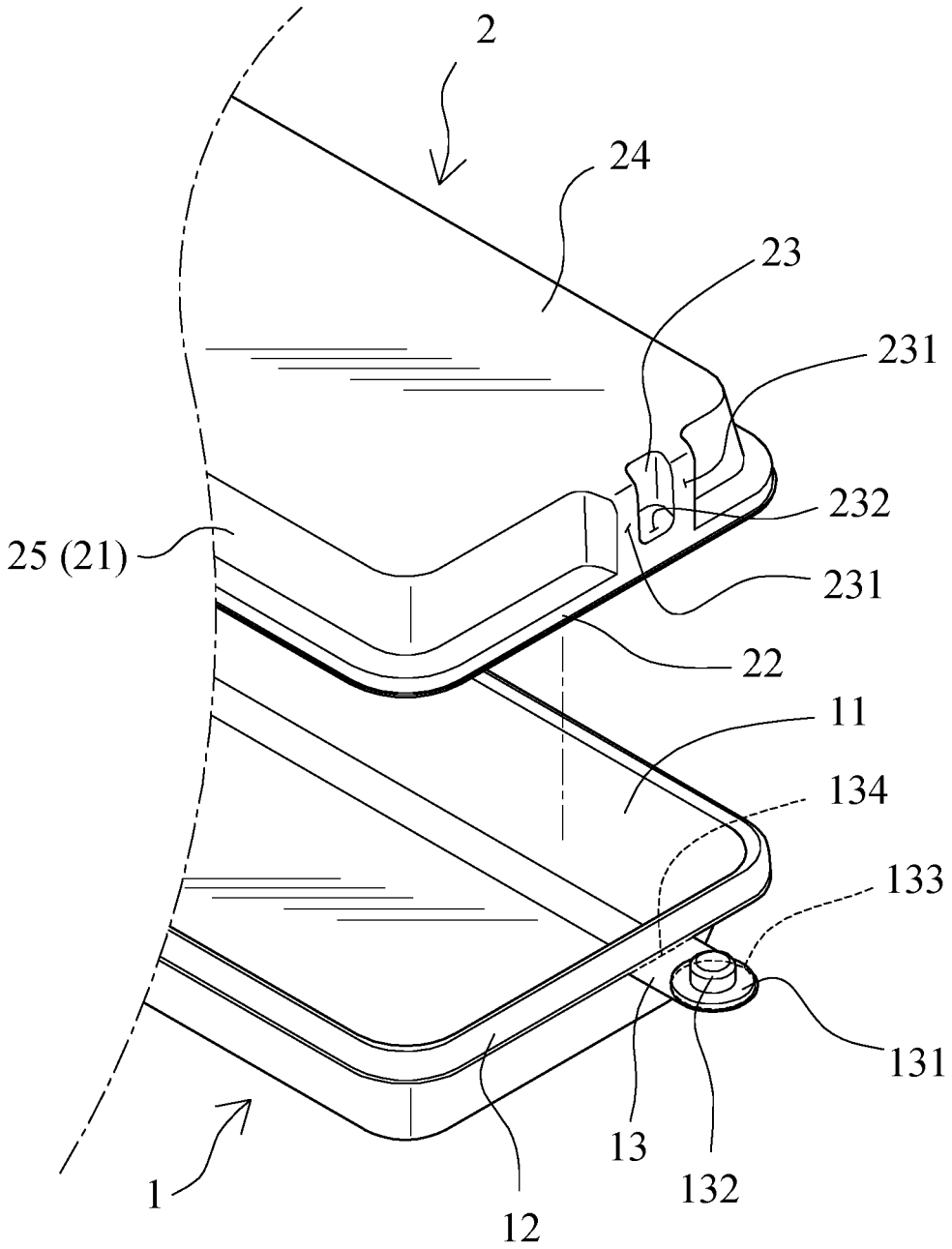
FIG. 1 is an exploded view of the box of the present invention.
Figure 2A:
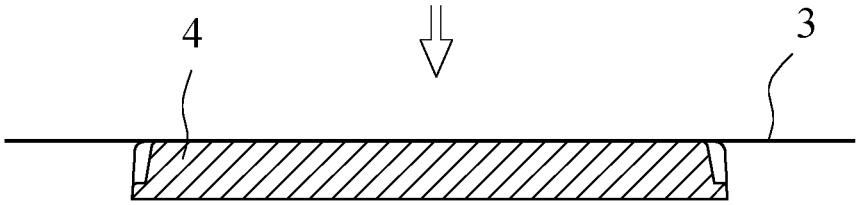
FIGS. 2A, 2B show the steps for making the cover of the box of the present invention.
Figure 2B:
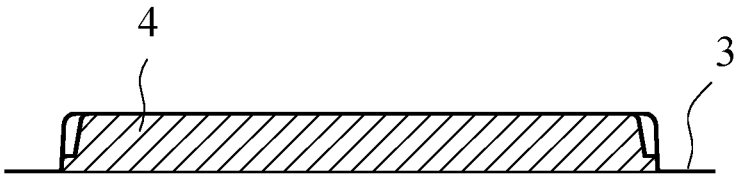
Figure 3A:
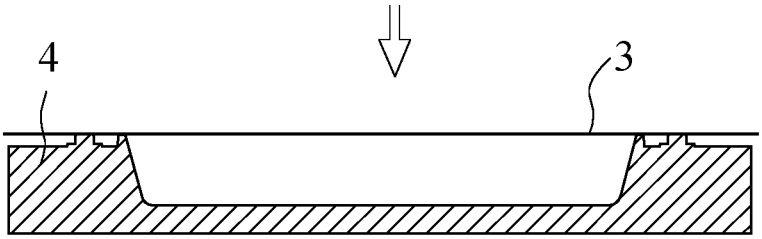
FIGS. 3A, 3B shows the steps for making the base of the box of the present invention.
Figure 3B:
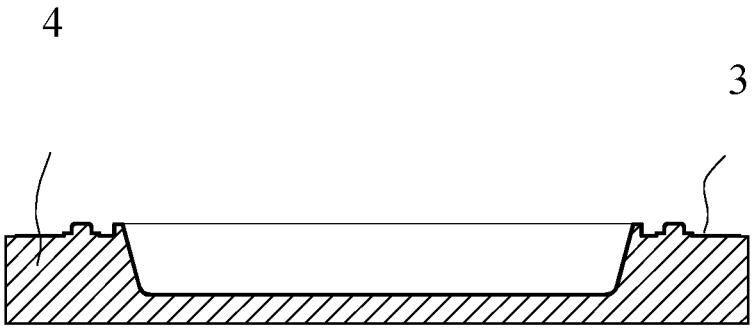
Figure 4:
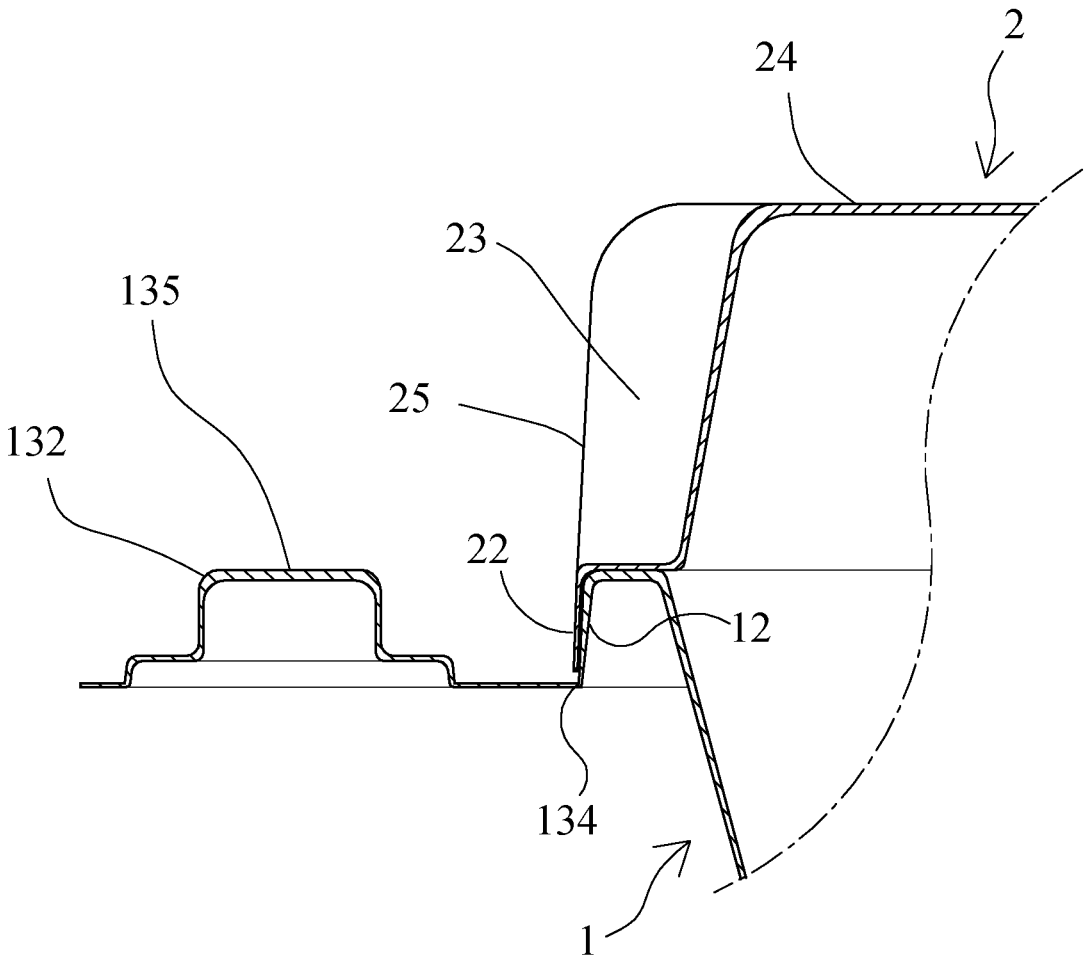
FIG. 4 is a cross sectional view to show the knob and the U-shaped recess of the box of the present invention.
Figure 5:
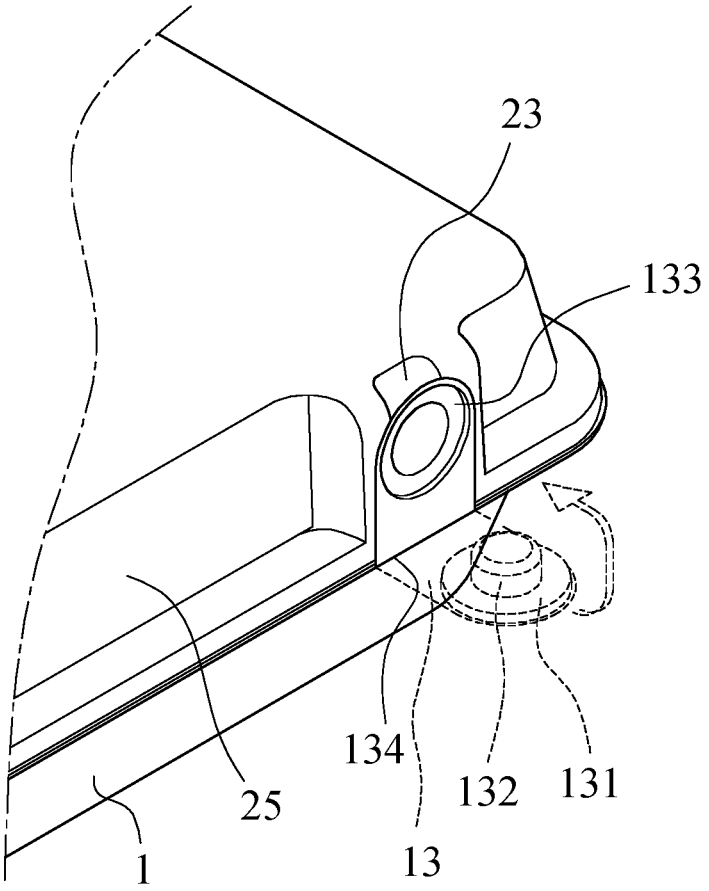
FIG. 5 shows that the knob is removably engaged with the U-shaped recess of the box of the present invention.

Referring to FIGS. 1, 4 and 5, the box of the present invention comprises a base 1 and a cover 2. The base 1 includes a first room 11 defined therein for receiving food therein, and a first lip 12 extends outward from the periphery of the top opening of the base 1. The cross section of the first lip 12 is an inverted U-shaped lip as shown in FIG. 4. At least one connection strip 13 extends from the periphery of the top opening of the base 1. Preferably, there is at least one connection strip 13 extending from each of two ends of the base 1 and extending from the first lip 12. Each connection strip 13 includes an extension portion 131 and a knob 132 is formed on the extension portion 131. Each knob 132 includes a press portion 133 defined in the top thereof, and the press portion 133 is a recessed area. A bending portion 134 is formed at the connection portion between the connection strip 13 and the first lip 12 because the thickness of the plastic material becomes thinner gradually at that position. Therefore, the connection strip 13 is bent or pivoted about the bending portion 134.

The cover 2 is removably mounted to the base 1, and includes a skirt 25 extending downward from the periphery of the cover top 24 of the cover 2 so as to form a second room 21 between the skirt 25 and the cover 2. A second lip 22 extends outward from the lower edge of the skirt 25 and performs as the edge of bottom opening of the cover 2. The second lip 22 is designed to be mounted to the outside of the first lip 12. The skirt 25 includes at least one U-shaped recess 23 formed in each of the outside thereof. Preferably, there is at least one recess U-shaped recess 23 formed in each of two ends of the cover 2. Each of the knobs 132 is adapted to be engaged with the U-shaped recess 23 corresponding thereto. It is noted that each of the U-shaped recesses 23 includes two reinforcement ribs 231 which extend perpendicularly from the outside of skirt 25 of the cover 2, and a U-shaped inside wall 232 is formed between the two reinforcement ribs 231. The first room 11 of the base 1 and the second room 21 of the cover 2 are combined to be a relatively large receiving room to accommodate more food or the like.

As shown in FIGS. 2A, 2B, 3A and 3B, each of the base 1 and the cover 2 is made by molding a plastic plate 3 in a molding set 4.

Figure 8:
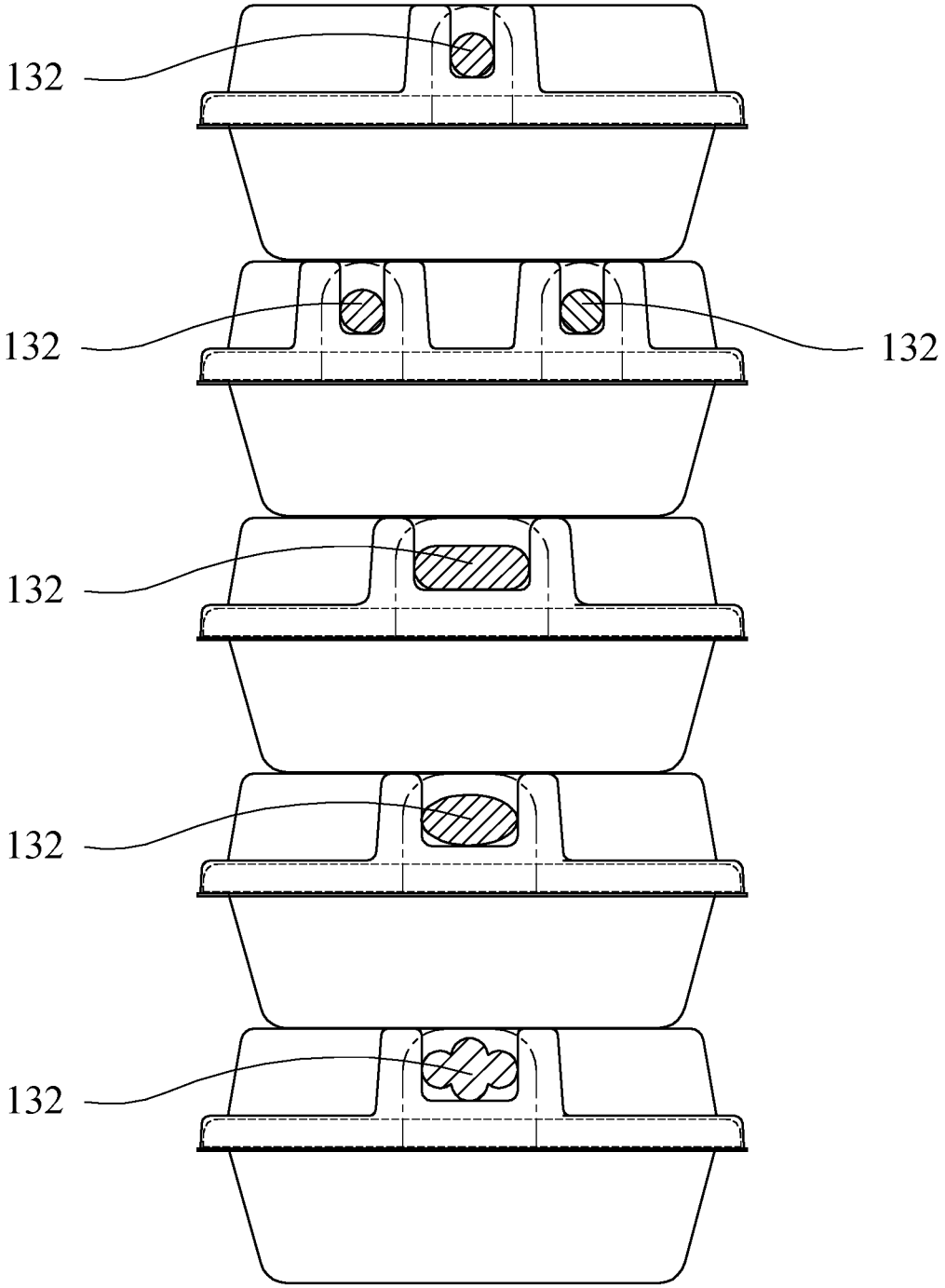
FIG. 8 shows different embodiments of the knobs engaged with the U-shaped recesses of the box of the present invention.

As shown in FIG. 4, the cover top 24 is the initial portion that is sucked to the surface of the molding set 4 and integrally form with the skirt 25, and the U-shaped recesses 23 are formed to the skirt 25 so that the second room 21 when overlayed on the base increases the room or space for accommodating foods therein, and the cover 2 is strengthened by the specific structure. The boxes can be stacked as seen in FIG. 8 and the covers 2 do not deform. The second lip 22 is integrally formed with the skirt 25 and shaped to be mounted to outside of the first lip 12. The base 1 is pressed to form the connection strips 13 which is bent by the bending portion 134 that is formed between the connection strip 13 and the first lip 12. The knob top 135 of the knob 132 is formed by the portion that is initially sucked to the molding set, the knob top 135 of the knob 132 is strong enough not to be deformed easily when the users pushes the knob top 135 into the U-shaped recess 23.

As shown in FIG. 5, when the cover 2 is mounted to the base 1, the connection strips 13 are easily bent to engage the knobs 132 with the U-shaped recesses 23 by pressing the press portion 133 of each knob 132. The press portion 133 is a recessed area for easily accommodating the users' thumb. When removing the cover 2 from the base 1, the user can pull the extension portion 131 to easily pop the knob 132 free from the U-shaped recess 23.

Figure 6A:
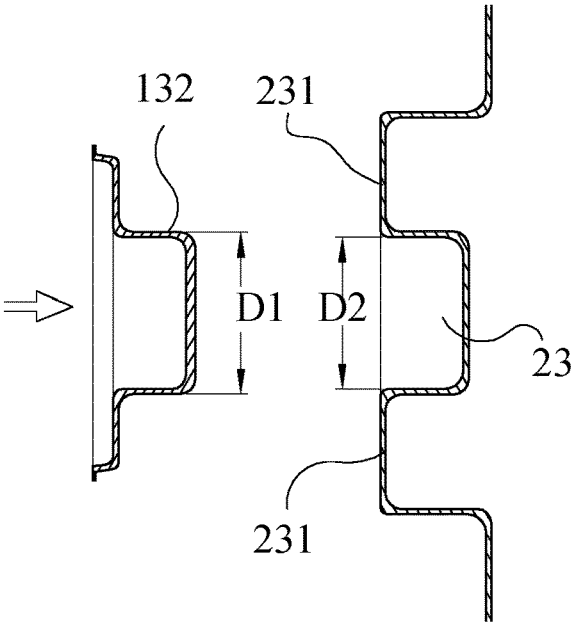
FIG. 6A shows the diameter of each of the knob and the U-shaped recess of the box of the present invention.
Figure 6B:
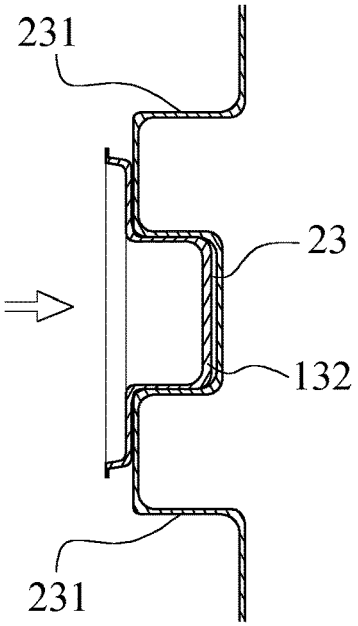
FIG. 6B is a cross section al view to show that the knob is engaged with the U-shaped recess of the box of the present invention.
Figure 7:
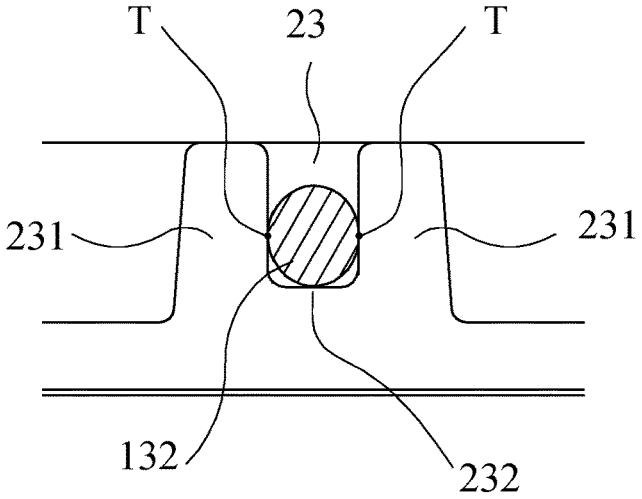
FIG. 7 shows the squeeze points when the knob is engaged with the U-shaped recess of the box of the present invention.

As shown in FIGS. 6A, 6B and 7, the diameter D1 of the knob 132 is slightly larger than the width D2 between the two squeeze points "T" of the two reinforcement ribs 231. The two squeeze points "T" ensure that the knob 132 is securely engaged with the U-shaped recess 23 and contacts the inside wall 232 which provides anti-slip feature.

The U-shaped recess 23 is defined between the two reinforcement ribs 231 and the inside wall 232, and the U-shaped recess 23 includes an open top and the two reinforcement ribs 231 are perpendicular to the skirt 25 so that when molding the cover, the molding set 4 is easily separated from the product and the two reinforcement ribs 231 are not deformed. The inside wall 232 ensures that the knob 132 is securely engaged with the U-shaped recess 23 even if the box is put upside down or tilted. The two reinforcement ribs 231 provide sufficient strength to support repeated engagement between the knob 132 and the U-shaped recess 23.

As shown in FIG. 8, the knob 132 is a hollow cylindrical knob, an oval knob, a regular shape knob or an irregular shape knob.

Figure 9:
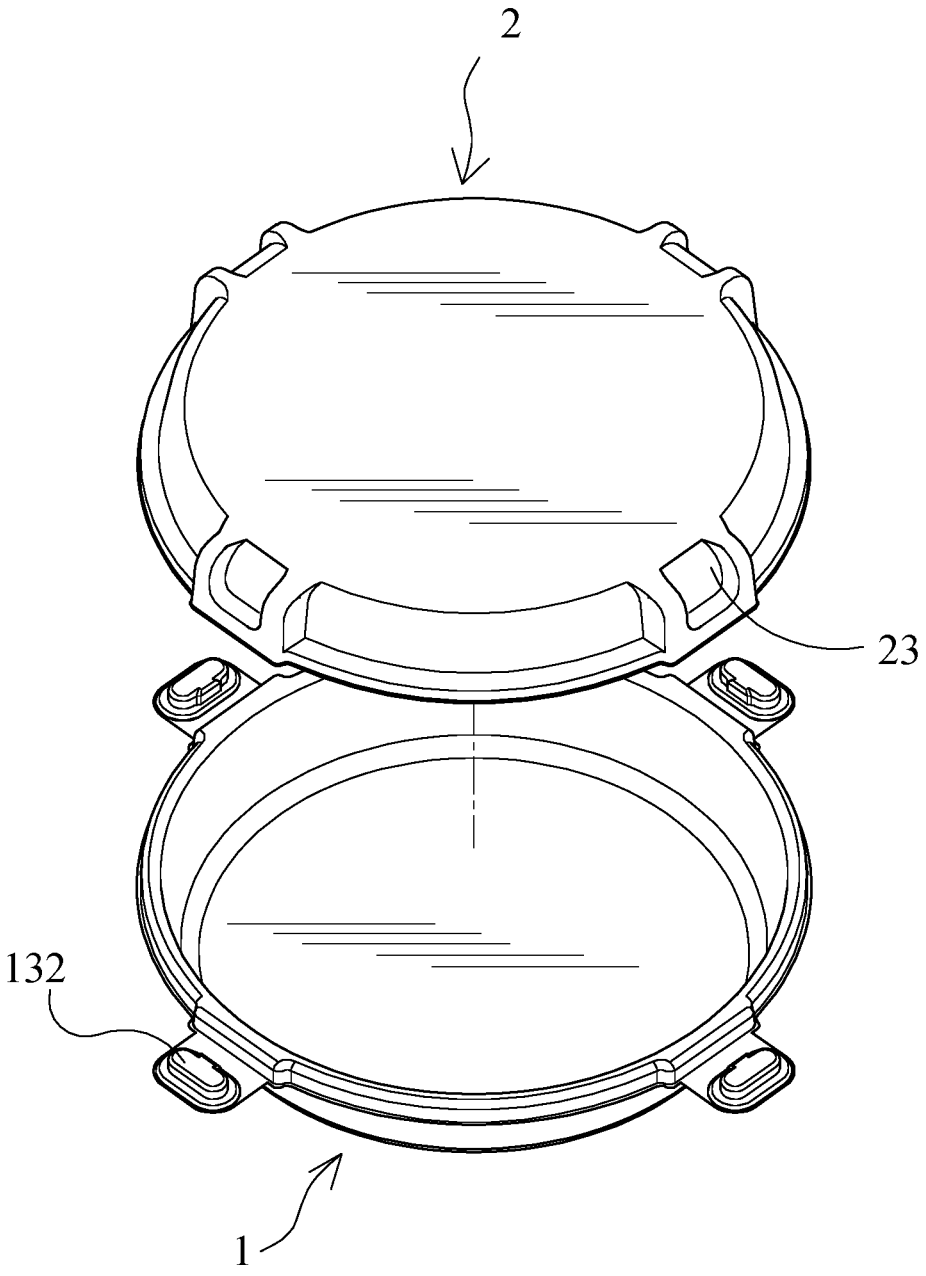
FIG. 9 shows the round base and the round cover of the box of the present invention.

As shown in FIG. 9, the base 1 and the cover 2 can be round or polygonal shaped. There are multiple sets of the knobs 132 and the U-shaped recesses 23 to securely connect the cover 2 to the base 1.

Figure 10A:
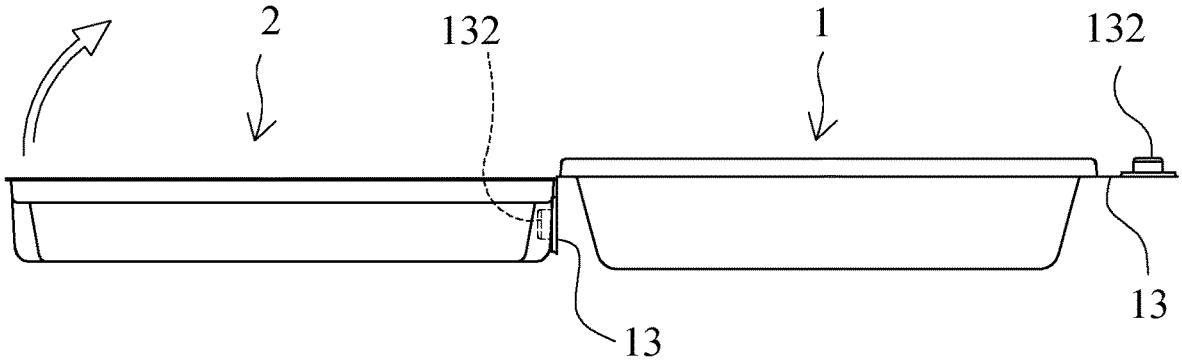
FIG. 10A shows that the cover is in the opened status relative to the base.
Figure 10B:
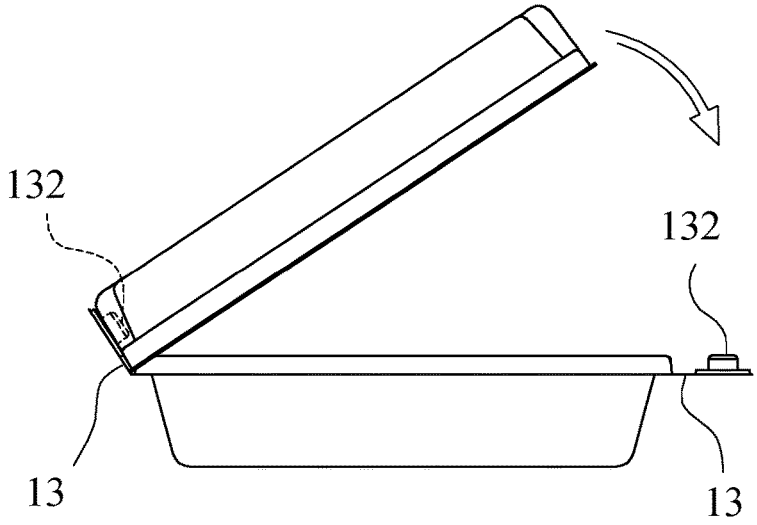
FIG. 10B shows that the cover is pivoted to be mounted to the base.
Figure 10C:
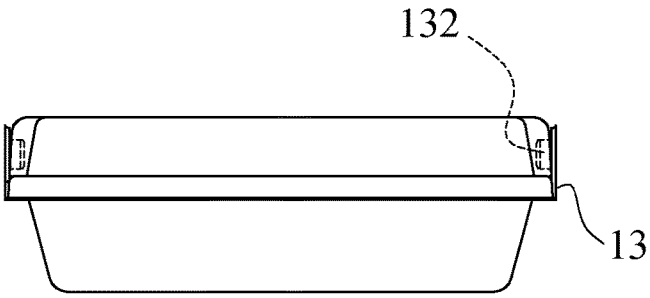
FIG. 10C shows that the cover is mounted to the base.

As shown in FIGS. 10A. 10B, 10C, when opening the cover 2, only one of the knobs 132 is separated from the U-shaped recess 23 corresponding thereto, the cover 2 is able to be opened by bending other connection strip 13 to allow the cover 2 to be opened 90 degrees or 180 degrees relative to the base 1 while remaining coupled to the base.

Figure 11A:
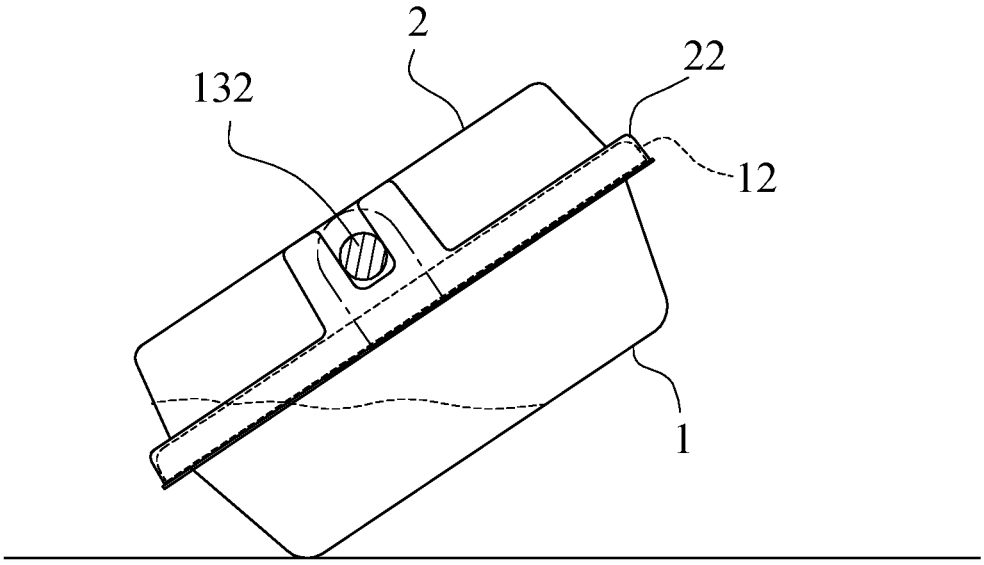
FIG. 11A shows that the box of the present invention is tilt.
Figure 11B:
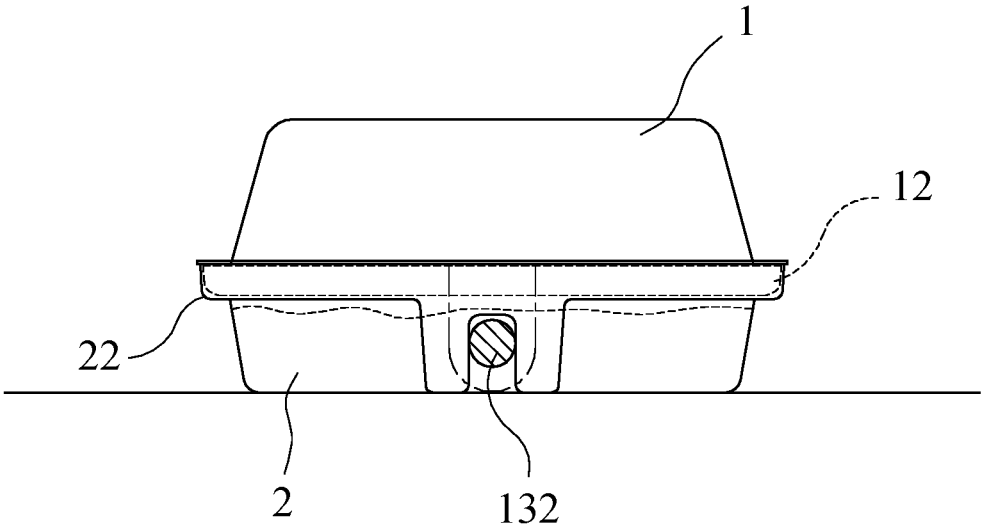
FIG. 11B shows that the box of the present invention is positioned upside down.

As shown in FIGS. 11A, 11B, thanks to the engagement between the first and second lips 12, 22, the content such as food in the box does not leak even if the box is upside down or tilt.

While we have shown and described the embodiment in accordance with the present invention, it should be clear to those skilled in the art that further embodiments may be made without departing from the scope of the present invention.

What is claimed is:

1. A box comprising:

a base having a first lip extending outward from a periphery of a top opening of the base, a first room defined in the base, a connection strip extending from a periphery of a top opening of the base, a knob formed on the connection strip, and a cover removably mounted to the base, the cover including a skirt extending from a periphery thereof so as to form a second room between a cover top of and the skirt that makes up the cover, a second lip extending outward from a lower edge of the skirt, the second lip mounted to outside of the first lip, the skirt including a U-shaped recess formed in an outside thereof, the U-shaped recess including two reinforcement ribs which extend perpendicularly from the outside of the skirt of the cover, a U-shaped inside wall formed between the two reinforcement ribs, the knob is adapted to be removably engaged with the U-shaped recess while also contacting the U-shaped inside wall.

2. The box as claimed in claim 1, wherein the connection strip includes an extension portion and the knob is formed on the extension portion.

3. The box as claimed in claim 1, wherein the knob includes a press portion defined on an outside thereof, the press portion being a recessed area.

4. The box as claimed in claim 1, wherein a bending portion is formed at a connection portion between the connection strip and the first lip.

5. The box as claimed in claim 1, wherein the knob comprises a hollow cylindrical knob or an oval knob.

6. The box as claimed in claim 1, wherein the base and the cover are round or polygonal shaped.

7. The box as claimed in claim 1, wherein a diameter of the knob is larger than a width between two squeeze points on the two reinforcement ribs, whereby the knob contacts against the two squeeze points so that the knob is securely frictionally engaged with the U-shaped recess, the knob contacting the U-shaped inside wall which is configured to provide anti-slip feature.

* * * * *